US008192182B2

(12) United States Patent
LeBoeuf et al.

(10) Patent No.: US 8,192,182 B2
(45) Date of Patent: Jun. 5, 2012

(54) MANUAL EVACUATION SYSTEM

(75) Inventors: William E. LeBoeuf, Midland, MI (US); Raechell Maria Thuot, Racine, WI (US); Leland J. Smith, Midland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 869 days.

(21) Appl. No.: 12/008,164

(22) Filed: Jan. 9, 2008

(65) Prior Publication Data

US 2009/0175747 A1 Jul. 9, 2009

(51) Int. Cl.
*F04B 53/12* (2006.01)
*F04B 53/00* (2006.01)
*B65D 81/20* (2006.01)

(52) U.S. Cl. ..... 417/545; 417/555.1; 99/472

(58) Field of Classification Search ..... 417/545, 417/259, 555.1, 523, 553, 470, 471, 444; 99/472, 467; 141/65
See application file for complete search history.

(56) References Cited

U.S. PATENT DOCUMENTS 1,821,900 A * 9/1931 Silvers ..... 417/555.1
2,024,367 A 12/1935 Eriksson-Jons
2,184,732 A 12/1939 Brewer
2,576,322 A 11/1951 Waters
2,636,657 A 4/1953 Lauritzen
2,648,474 A * 8/1953 Crook ..... 141/65
2,890,810 A * 6/1959 Rohling ..... 220/231
3,018,779 A * 1/1962 Tyler et al. ..... 604/181
3,312,256 A 4/1967 Reisinger
3,319,577 A * 5/1967 Herreshoff ..... 417/511
3,334,628 A 8/1967 Saemann et al.
3,752,604 A * 8/1973 Dorn ..... 417/511
3,828,520 A 8/1974 Merritt
4,051,971 A 10/1977 Saleri et al.
4,249,583 A 2/1981 Lundbladh
4,278,114 A * 7/1981 Ruberg ..... 141/65
4,287,819 A * 9/1981 Emerit ..... 99/472
4,301,826 A * 11/1981 Beckerer ..... 137/149
4,337,804 A 7/1982 Maruscak
4,583,925 A * 4/1986 Hawkins ..... 417/555.1
4,615,361 A 10/1986 Bartle, Sr.
4,656,687 A 4/1987 Wei
4,741,789 A 5/1988 Zieke et al.
4,745,730 A 5/1988 Bartle, Sr.
4,755,248 A 7/1988 Geiger et al.
4,763,803 A 8/1988 Schneider (Continued)

OTHER PUBLICATIONS

U.S. Appl. No. 11/725,120, filed Mar. 16, 2007.

(Continued)

*Primary Examiner* — Charles Freay
*Assistant Examiner* — Alexander Comley

(57) ABSTRACT

A gastight interface for an evacuation device includes a flexible suction cup adapted to form a gastight seal with a surface surrounding a valve disposed on a container and extending from an evacuation end of an evacuation chamber. The flexible suction cup has an aperture disposed therethrough for fluid communication with the evacuation chamber. A plurality of support members extends from the evacuation end of the evacuation chamber to restrict movement of the flexible suction cup between the surface and the evacuation end of the evacuation chamber, to allow fluid communication between an interior of the container and the evacuation chamber through the valve when the valve is in an open position, while the piston is being reciprocated between the closed end and the evacuation end. Each support member has a distal surface disposed outside of an outer perimeter of the flexible suction cup.

15 Claims, 11 Drawing Sheets

U.S. PATENT DOCUMENTS 4,927,474 A 5/1990 Pawloski
4,941,310 A 7/1990 Kristen
4,975,028 A * 12/1990 Schultz ..... 417/442
4,984,611 A 1/1991 Takatsuki et al.
4,989,292 A 2/1991 Hwang
5,012,561 A 5/1991 Porchia et al.
5,031,785 A 7/1991 Lemme
5,097,648 A 3/1992 Berner et al.
5,121,590 A 6/1992 Scanlan
5,142,970 A 9/1992 ErkenBrack
5,195,427 A 3/1993 Germano
5,228,271 A 7/1993 Wallace
5,263,520 A 11/1993 Arai
5,296,769 A 3/1994 Havens et al.
5,299,917 A * 4/1994 Schultz ..... 417/238
5,304,041 A 4/1994 Fontanazzi et al.
5,332,095 A 7/1994 Wu
5,338,166 A * 8/1994 Schultz ..... 417/442
5,347,918 A 9/1994 Chen
D351,896 S 10/1994 Sundheim et al.
D352,900 S 11/1994 Nhan
5,364,241 A * 11/1994 Schultz ..... 220/203.11
5,405,038 A * 4/1995 Chuang ..... 220/231
5,419,769 A 5/1995 Devlin et al.
5,449,079 A 9/1995 Yang
5,494,165 A 2/1996 Detrick
5,494,410 A * 2/1996 Maier-Laxhuber et al. .... 417/53
5,540,557 A * 7/1996 Carson ..... 417/53
5,564,480 A 10/1996 Chen
5,564,581 A 10/1996 Lin
5,570,628 A 11/1996 Kiener et al.
5,611,376 A 3/1997 Chuang
5,638,664 A 6/1997 Levsen et al.
5,638,971 A 6/1997 Justesen
5,651,470 A 7/1997 Wu
5,653,251 A 8/1997 Handler
5,655,273 A 8/1997 Tomic et al.
5,689,866 A 11/1997 Kasai et al.
5,692,649 A 12/1997 Schwab
5,699,838 A 12/1997 Catallo et al.
5,735,317 A 4/1998 Wu
5,765,608 A 6/1998 Kristen
5,779,082 A 7/1998 Miramon
5,788,463 A * 8/1998 Chan ..... 417/63
D398,548 S 9/1998 Nakazato et al.
5,806,575 A 9/1998 Tsay
5,826,631 A 10/1998 Gold et al.
5,839,582 A 11/1998 Strong et al.
5,873,217 A 2/1999 Smith
5,881,881 A 3/1999 Carrington
D417,618 S 12/1999 Shanklin et al.
D419,446 S 1/2000 Durliat
6,017,195 A 1/2000 Skaggs
6,032,827 A 3/2000 Zettle et al.
6,070,397 A 6/2000 Bachhuber
6,185,796 B1 2/2001 Ausnit
6,202,849 B1 3/2001 Graham
6,216,314 B1 4/2001 Dangerfield
6,250,343 B1 6/2001 Chen
6,256,968 B1 7/2001 Kristen
D446,852 S 8/2001 Johansen et al.
D446,853 S 8/2001 Johansen et al.
6,408,872 B1 6/2002 Skeens et al.
6,412,669 B1 7/2002 Chuang
D467,334 S 12/2002 Homma
6,520,071 B1 2/2003 Lanza
D472,674 S 4/2003 Long et al.
6,575,191 B2 6/2003 Skeens et al.
6,581,641 B2 * 6/2003 Skeens et al. ..... 137/845
6,626,092 B2 9/2003 Tarlow
6,634,384 B2 10/2003 Skeens et al.
6,652,251 B1 11/2003 Chen
6,675,982 B2 1/2004 Heil et al.
6,712,334 B2 3/2004 Motonaka et al.
6,732,874 B2 5/2004 Zilberman
6,763,857 B2 7/2004 Brown
6,792,982 B2 9/2004 Lincoln et al.
D499,428 S 12/2004 Warden
6,830,081 B1 12/2004 Chen
6,837,268 B2 1/2005 Skeens et al.
6,839,933 B2 1/2005 Wheeler et al.
6,862,980 B2 3/2005 Heil et al.
6,877,629 B2 4/2005 Meyer
6,954,969 B1 10/2005 Sprehe
6,968,870 B1 11/2005 Tsay
6,971,417 B2 12/2005 Deni
6,976,669 B2 12/2005 Van Zijll Langhout et al.
D513,924 S 1/2006 Benedict
6,990,790 B2 1/2006 Yasuhira
6,991,109 B1 1/2006 Shannon et al.
6,997,829 B2 * 2/2006 Kennedy et al. ..... 473/593
7,041,249 B2 5/2006 Wright et al.
7,063,231 B2 6/2006 Stanos et al.
D525,823 S 8/2006 Littmann
D526,155 S 8/2006 Littmann
D527,502 S 8/2006 Yoshimoto et al.
7,093,624 B2 8/2006 Chen
7,096,893 B2 8/2006 Vilalta et al.
7,108,147 B2 9/2006 Cheung
7,127,875 B2 10/2006 Cheung
7,131,550 B2 11/2006 Vilalta et al.
7,178,555 B2 2/2007 Engel et al.
7,246,555 B2 * 7/2007 Small et al. ..... 99/472
7,422,369 B2 9/2008 Bergman et al.
7,565,978 B2 7/2009 Han
7,597,479 B2 10/2009 Zimmerman et al.
2003/0116466 A1 6/2003 Goto
2004/0040961 A1 3/2004 Vilalta et al.
2004/0091179 A1 5/2004 Anderson
2004/0177771 A1 9/2004 Small et al.
2004/0226458 A1 11/2004 Tarlow
2004/0234172 A1 11/2004 Pawloski
2005/0022473 A1 2/2005 Small et al.
2005/0022474 A1 2/2005 Albritton et al.
2005/0022480 A1 2/2005 Brakes
2005/0023179 A1 2/2005 Albritton
2005/0028488 A1 2/2005 Higer et al.
2005/0028493 A1 2/2005 Small et al.
2005/0028494 A1 2/2005 Higer et al.
2005/0029152 A1 2/2005 Brakes et al.
2005/0034427 A1 2/2005 Higer et al.
2005/0035021 A1 2/2005 Higer et al.
2005/0037164 A1 2/2005 Wu et al.
2005/0039420 A1 2/2005 Albritton et al.
2005/0050855 A1 3/2005 Baptista
2005/0050856 A1 3/2005 Baptista
2005/0061813 A1 3/2005 Vilalta et al.
2005/0102975 A1 5/2005 Hughes et al.
2005/0172834 A1 8/2005 Lee
2005/0175469 A1 8/2005 Lucchi
2005/0286808 A1 12/2005 Zimmerman et al.
2006/0048483 A1 3/2006 Tilman et al.
2006/0093242 A1 5/2006 Anzini et al.
2006/0111226 A1 5/2006 Anzini et al.
2006/0177158 A1 8/2006 Scholtis et al.
2006/0201576 A1 9/2006 Domenig
2006/0228057 A1 10/2006 Newrones et al.
2006/0231556 A1 10/2006 Wei
2007/0092167 A1 4/2007 Tilman et al.
2007/0154118 A1 7/2007 Tilman et al.
2007/0155607 A1 7/2007 Bassett et al.
2007/0172157 A1 7/2007 Buchman
2007/0237661 A1 * 10/2007 Chen ..... 417/545

OTHER PUBLICATIONS

U.S. Appl. No. 11/818,584, filed Jun. 15, 2007.
U.S. Appl. No. 11/818,585, filed Jun. 15, 2007.
U.S. Appl. No. 11/818,586, filed Jun. 15, 2007.
U.S. Appl. No. 11/818,591, filed Jun. 15, 2007.
U.S. Appl. No. 11/818,593, filed Jun. 15, 2007.

* cited by examiner

MANUAL EVACUATION SYSTEM

CROSS REFERENCE TO RELATED APPLICATIONS

Not applicable.

REFERENCE REGARDING FEDERALLY SPONSORED RESEARCH OR DEVELOPMENT

Not applicable

SEQUENTIAL LISTING

Not applicable

FIELD OF THE INVENTION

The present invention generally relates to vacuum devices, more particularly, to manual vacuum devices intended for use in evacuating gases, including air, from plastic storage pouches.

BACKGROUND OF THE INVENTION

Vacuum evacuation of a container may be used to preserve freshness of food or other perishables within the container. Vacuum evacuation may also be used to reduce gas volume to increase storage space for blankets, clothes, or other compressible contents within a container. Hand operated, or manual, vacuum devices can be light weight, of simple construction, and cheap to produce. Manual vacuum devices have been used to evacuate deformable and rigid containers and have also been used in conjunction with a variety of one-way valves to create evacuation systems.

One manual vacuum device has a two-stroke piston pump for evacuating deformable and rigid containers. The pump has a piston disposed inside a cylinder, the cylinder having a pluggable flexible vacuum cup disposed on a bottom end thereof. The piston has a peripheral check valve that allows gas to flow past the piston toward a cylinder cap. To evacuate rigid containers, the flexible vacuum cup is placed over a flexible check valve that is applied over access openings of the rigid containers. The flexible vacuum cup is prevented from completely collapsing under a pumping action by an inwardly projecting annular lip on a bottom end of the pump cylinder. The cylinder also has a pluggable port through a side wall of the cylinder to allow attachment of a flexible hose to aid in evacuating deformable containers.

Another manual vacuum device has a one-piece elastomeric end cap and vacuum cup assembly that fits around a bottom end of a cylinder. A suction cup on a bottom end of the assembly extends from an annular base that surrounds a central recess. The central recess defines an uncollapsible space between the bottom end of the assembly and a container surface.

Yet another manual vacuum device has a cylinder with a lower end that flares outwardly to define a frustoconical outer surface. A suction cup having a central aperture is disposed inside an end of the cylinder. A periphery of the suction cup extends radially past the flared end of the cylinder allowing the periphery of the suction cup to collapse, but leaving a central chamber defined by an uncollapsed central portion of the suction cup.

A still further manual vacuum device has a pump that attaches to a central portion of a container cover. The pump has a cylinder and a piston that has a peripheral check valve that allows gas to flow past the piston away from the container. The cylinder is press fit over a flange on the container cover such that a sealing engagement is accomplished between a face of the cylinder and the flange, as well as between an end surface of the cylinder and an upper surface of the cover.

Another manual vacuum device has an outer tube that telescopically slides on an inner tube, the inner tube having a piston at a top end thereof. The top end of the outer tube has a cap with a check valve for allowing gas to flow out of the outer tube. A bottom end of the inner tube is open and is press fit over a rigid one-way valve on a container. The piston has a central hole and a peripheral check valve that allows gas to flow past the piston toward the container and out of the pump through a space between the tubes. Pulling the outer tube away from the container creates a vacuum in the inner tube and pushing the outer tube toward the container forces gas out of the outer tube.

Another manual vacuum device has a piston with a peripheral check valve disposed in a cylinder. An elastomeric suction cup and an elastomeric valve housing are fitted over a bottom end of the cylinder. Moving the piston away from the suction cup draws a vacuum on the suction cup. Moving the piston toward the suction cup causes a one-way ball valve in the elastomeric housing to close and forces gas in the cylinder past the piston and out to the atmosphere through a hole in a top end of the cylinder.

A further manual vacuum device has a piston disposed in a cylinder for evacuating freezer bags. A conical nozzle having an axial passageway is attached at a wide end of the nozzle to an end of the cylinder. The piston has a peripheral check valve that allows gas to flow past the piston and away from the nozzle. The nozzle has four lateral passages near a narrow end thereof, the passages connecting the axial passageway to an outer surface of the nozzle. A check valve covers the nozzle axial passageway at the end of the cylinder allowing gas to enter the cylinder. A circumferential groove is disposed in the outer surface of the nozzle. The groove is positioned between the lateral passages and the wide end of the nozzle for the purpose of receiving an O-ring for tightly holding freezer bag walls against the nozzle.

A reversible manual vacuum device has a piston movable inside a cylinder for evacuating a bottle through a stopper that has a slit valve and is disposed in an open end of the bottle. The stopper has a peripheral flange and a raised annular wall extending upwardly from the flange. A bottom of the cylinder fits around the annular wall and contacts the peripheral flange. A piston disposed on an end of a hollow piston rod slides within the cylinder and a reversible one-way mushroom valve is disposed within a hole in the center of the piston. A reversible combination vacuum and pressure valve is also disposed in the stopper. Drawing the piston away from the stopper creates a vacuum in the cylinder. Pushing the piston toward the stopper forces gas through the mushroom valve, into the hollow piston rod, and out to the atmosphere through a hole in a top end of the piston rod.

Yet another manual vacuum device functions to draw a sudden vacuum on containers and bodily wounds. The pump has a hollow piston rod connected to a piston disposed in a cylinder. The cylinder has a closed end and a gas-flow orifice at an opposite end with a cup shaped end member having a central opening disposed over the orifice. The piston has a peripheral check valve that allows gas to flow past the piston toward the orifice. When the piston is drawn away from the orifice, gas in the volume between the piston and the closed end escapes past the check valve, travels through the hollow piston rod, and exhausts out of the piston rod to the atmosphere through a hole near a top end of the piston rod. When the piston is pushed back toward the orifice, the volume of gas between the piston and a top of the cylinder expands causing a vacuum to be created. As the piston nears the orifice, the hole in the piston rod comes into communication with the volume of gas between the piston and the closed end of the cylinder, which causes a sudden vacuum to be drawn on the orifice.

A manual vacuum evacuation system has a rigid check-valve in a bag wall and a pump for evacuating gas from the bag. The check-valve has an inner part that extends through a hole in the bag wall and threadably mates with an outer part of the check-valve to squeeze the bag wall and a flat holding washer therebetween. The pump has a cylinder and a piston disposed in the cylinder, the piston having a peripheral check valve. An open end of the cylinder has an annular flange over which fits an elastomeric ring. The ring has an annular wall extending from a bottom side of the ring, the annular wall being placed against a surface of the flat washer to seal the pump to the valve.

SUMMARY OF THE INVENTION

In one aspect of the present invention, a pump for evacuating a container comprises an evacuation chamber having a closed end and an evacuation end, and a piston slidably disposed within the evacuation chamber and attached to a first end of a piston rod. The piston rod extends through an opening in the closed end of the evacuation chamber, and a handle is attached to a second end of the piston rod. A check valve is disposed on the piston to allow gas to flow past the piston when the piston is reciprocated toward the evacuation end of the evacuation chamber. A flexible suction cup is adapted to form a gastight seal with a surface and extends from the evacuation end of the evacuation chamber. The flexible suction cup has an aperture disposed therethrough for fluid communication with the evacuation chamber. A plurality of support members extends from the evacuation end of the evacuation chamber to restrict movement of the flexible suction cup between the surface and the evacuation end of the evacuation chamber to prevent a portion of the suction cup from collapsing onto the surface while still maintaining a gastight seal with the surface. Each support member has a distal surface disposed outside of an outer perimeter of the flexible suction cup.

In another aspect of the present invention, an evacuation system comprises a one-way valve disposed on a container and a pump for evacuating the container. The pump includes an evacuation chamber having a closed end and an evacuation end, and a piston slidably disposed within the evacuation chamber. The piston is attached to a first end of a piston rod, wherein the piston rod extends through an opening in the closed end of the evacuation chamber and a handle is attached to a second end of the piston rod. A check valve is disposed on the piston to allow gas to flow past the piston when the piston is reciprocated toward the evacuation end of the evacuation chamber. A flexible suction cup is adapted to form a gastight seal with a surface of the container surrounding the one-way valve and extends from the evacuation end of the evacuation chamber. The flexible suction cup has an aperture disposed therethrough for fluid communication with the evacuation chamber. A plurality of support members extends from the evacuation end of the evacuation chamber to restrict movement of the flexible suction cup between the surface and the evacuation end of the evacuation chamber, to allow fluid communication between an interior of the container and the evacuation chamber through the one-way valve when the one-way valve is in an open position, while the piston is being reciprocated between the closed end and the evacuation end. Each support member has a distal surface disposed outside of an outer perimeter of the flexible suction cup.

In a further aspect of the present invention, a gastight interface for an evacuation device comprises a flexible suction cup adapted to form a gastight seal with a surface surrounding a valve disposed on a container and extending from an evacuation end of an evacuation chamber. The flexible suction cup has an aperture disposed therethrough for fluid communication with the evacuation chamber. A plurality of support members extends from the evacuation end of the evacuation chamber to restrict movement of the flexible suction cup between the surface and the evacuation end of the evacuation chamber to allow fluid communication between an interior of the container and the evacuation chamber through the valve when the valve is in an open position while the piston is being reciprocated between the closed end and the evacuation end. Each support member has a distal surface disposed outside of an outer perimeter of the flexible suction cup.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

The present disclosure is directed to apparatuses such as vacuum pumps that create a vacuum to evacuate a void volume and/or to remove a gas, such as air, from a container. A container may include, for example, a sealable plastic container, a storage pouch with a valve, a can, a bottle, a hermetically sealable volume, a container with a removable lid with a valve associated therewith, and the like, and/or other containers suitable for vacuum packaging. While specific embodiments are discussed herein, it is understood that the present disclosure is to be considered only as an exemplification of the principles of the invention. The present disclosure is not intended to limit the disclosure to the embodiments illustrated.

As seen in FIGS. 1-6, an embodiment of a manual vacuum pump 50 includes a tube, or an evacuation chamber, 100 that has a first opening 200 at a first end, or an evacuation end, 202 and a second opening 204 at a second end, or a closed end, 206. The tube 100 is illustratively shown in FIGS. 1 and 2 as having a cross section that is circular, but the tube may have a cross section that is elliptical, triangular, rectangular, hexagonal, octagonal, or some other suitable shape. The shape of the tube 100 may be selected to provide for enhanced gripping and control by a user, for ease of manufacture, or for other reasons. It is also contemplated that the tube 100 may be covered by a slip-on outer sleeve (not shown) having tackiness, compressibility, or other properties to further enhance gripping and control by a user.

Figure 1:
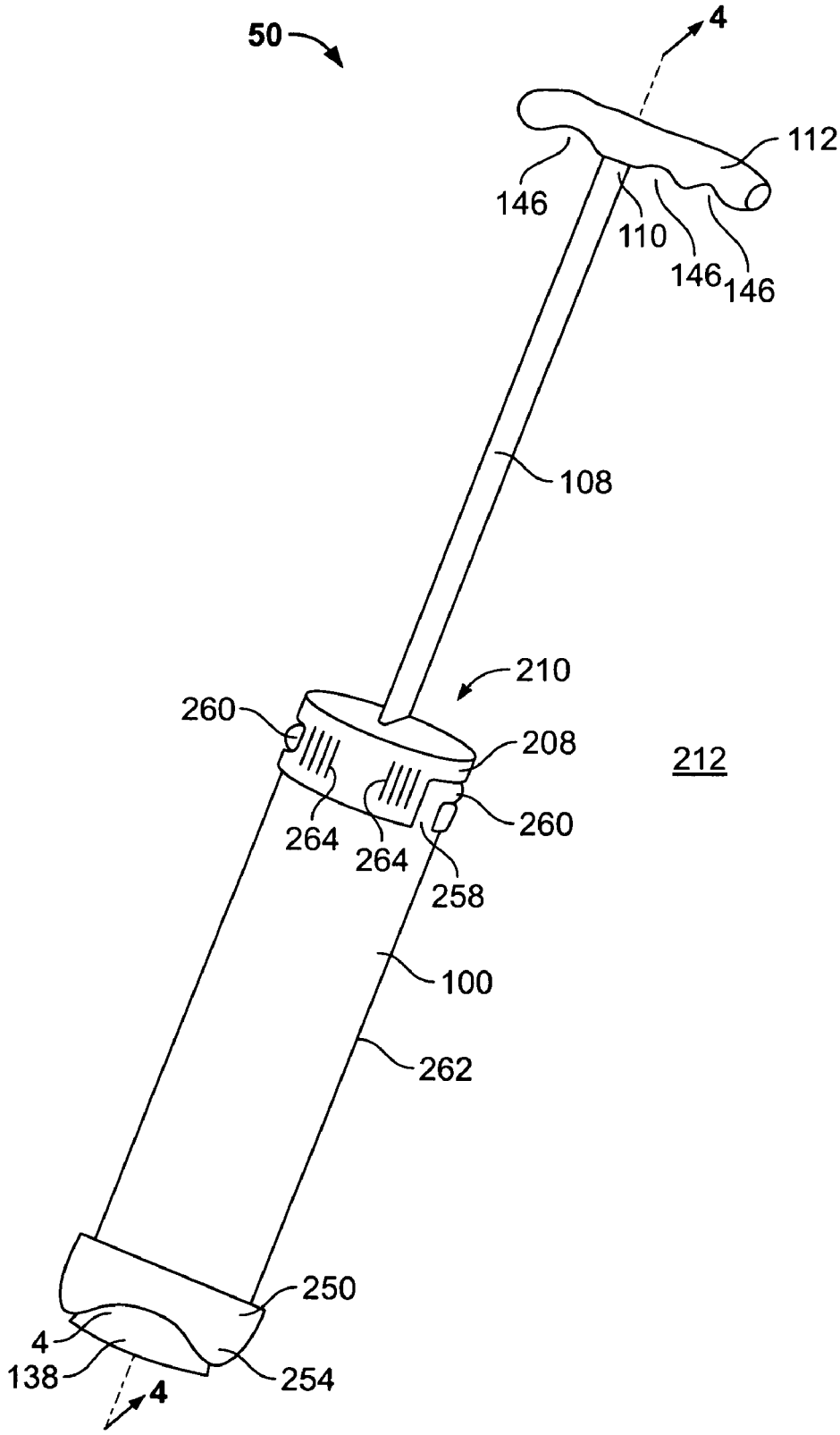
FIG. 1 is an isometric view of a manual vacuum pump.
Figure 2:
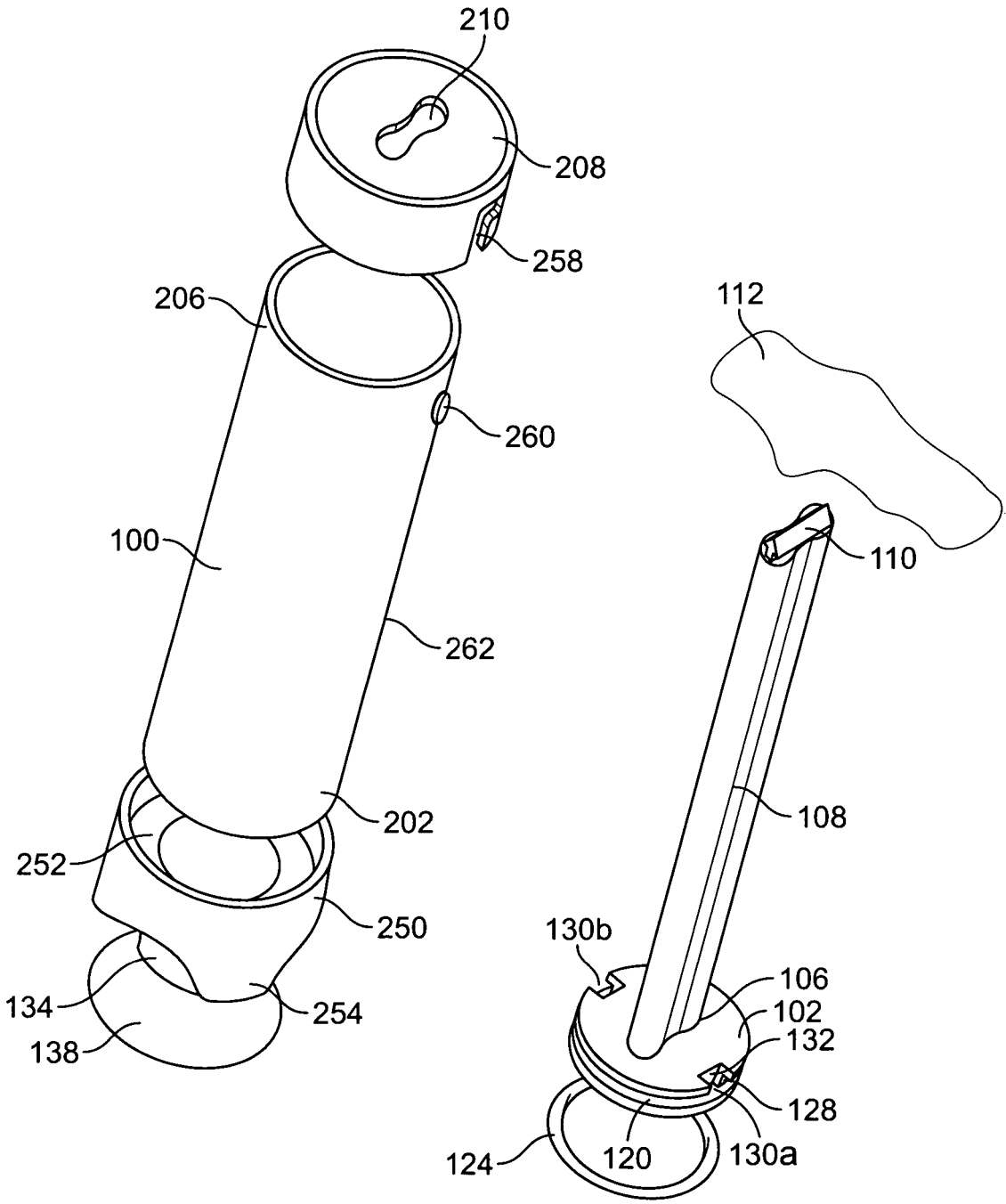
FIG. 2 is an exploded isometric view of the manual vacuum pump of FIG. 1.
Figure 3:
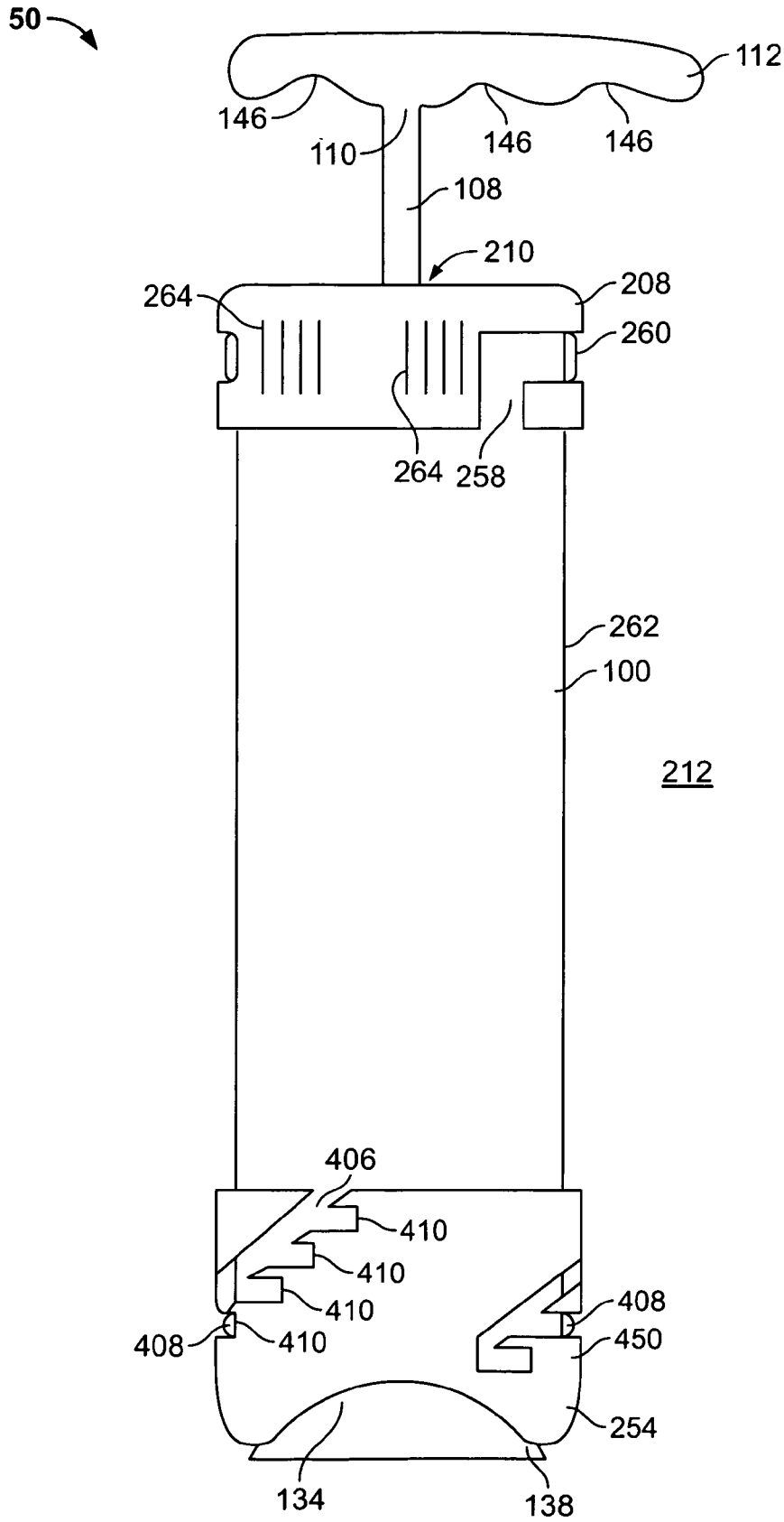
FIG. 3 is a plan view of the manual vacuum pump of FIG. 1.
Figure 4:
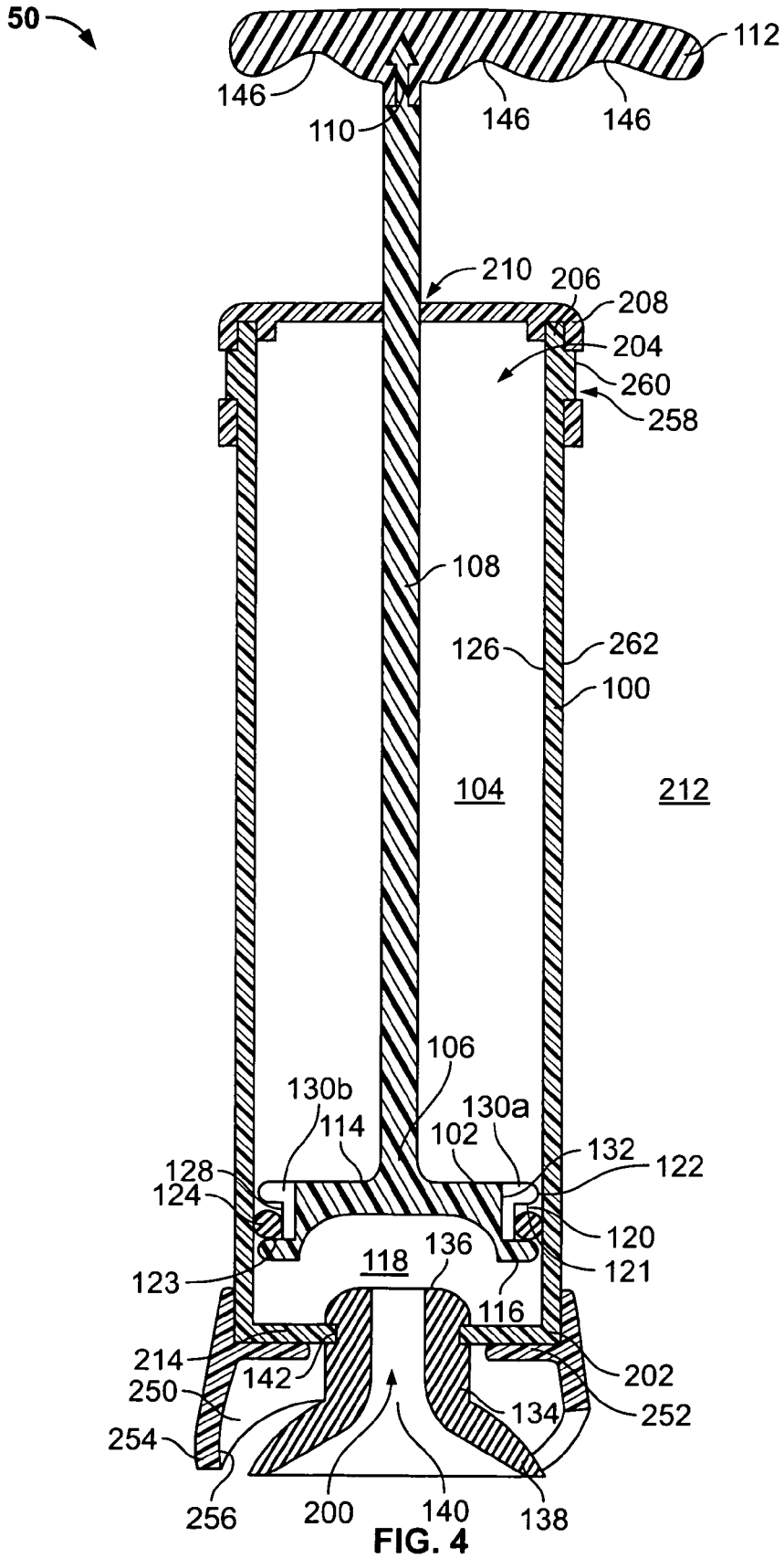
FIG. 4 is a cross-sectional view of the manual vacuum pump, taken generally along the lines 4-4 in FIG. 1.
Figure 5:
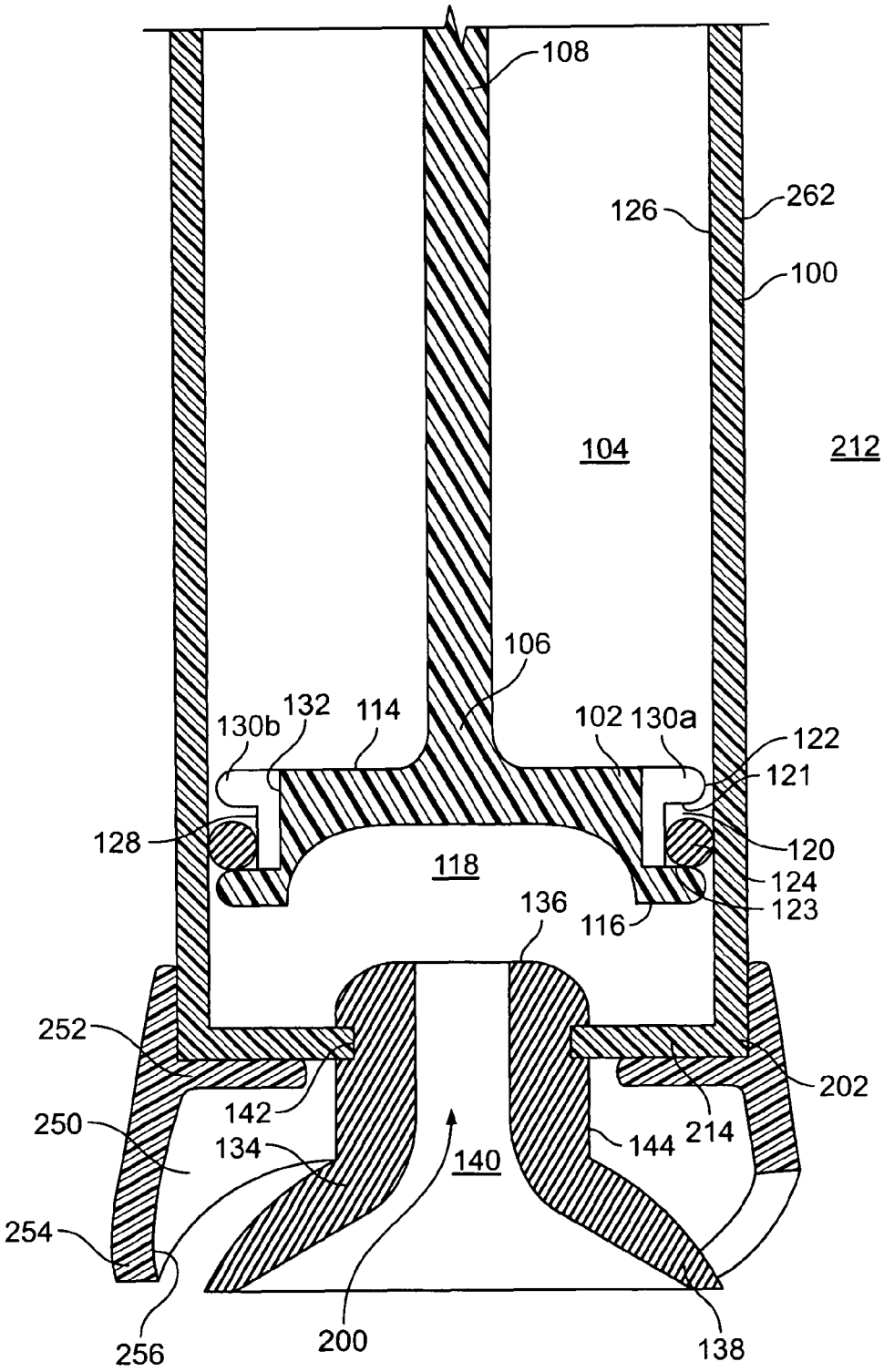
FIG. 5 is a first enlarged view of the cross-sectional view of FIG. 4.
Figure 6:
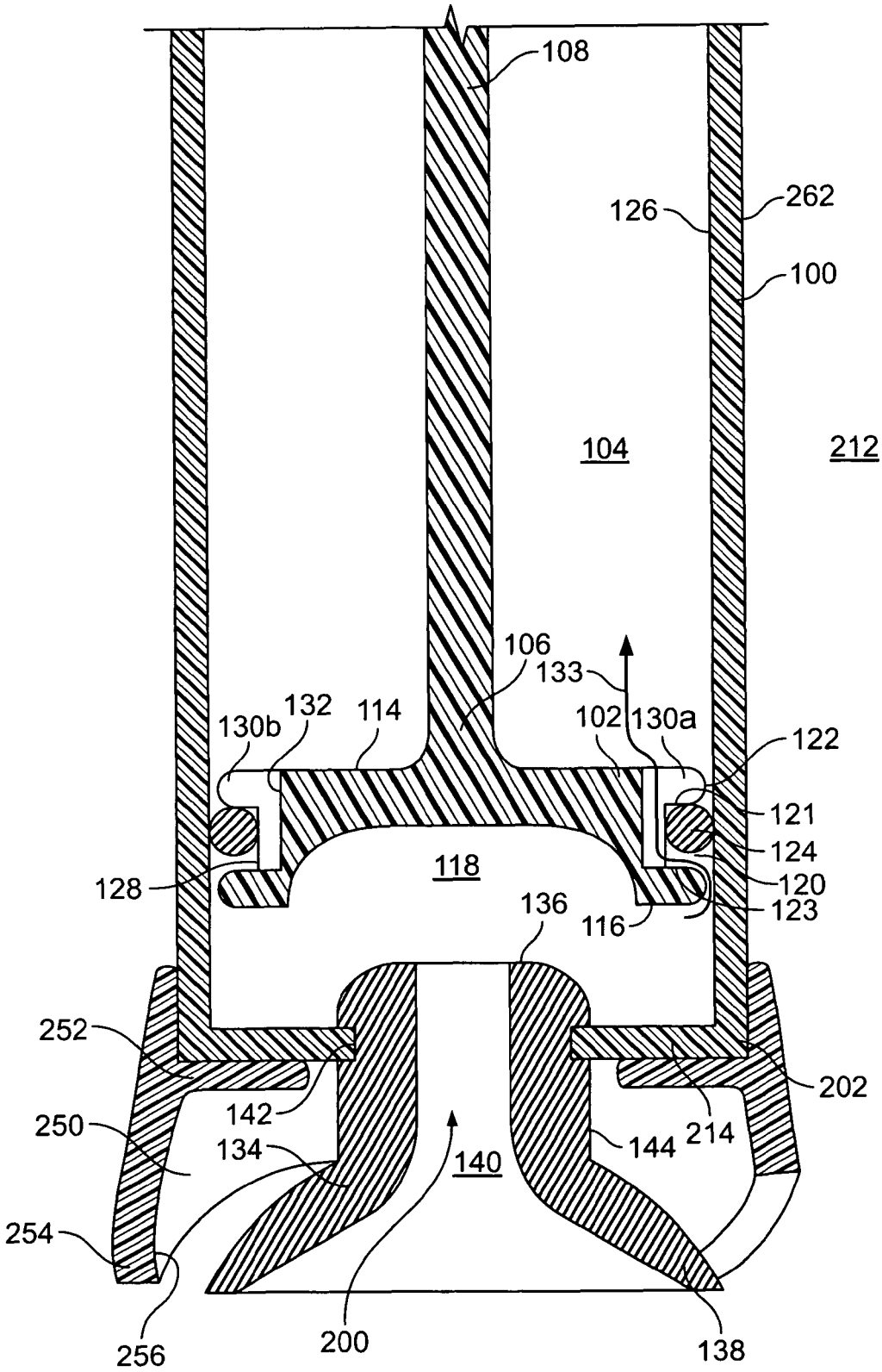
FIG. 6 is a second enlarged view of the cross-sectional view of FIG. 4.

A piston 102 is disposed in an interior 104 of the tube 100, as shown in FIGS. 4-6. A first end 106 of a piston rod 108 is attached to the piston 102. An end cap 208 shown in FIGS. 1-4 is attached to and covers the second opening 204 of the tube 100. The end cap 208 has a rod aperture 210 disposed through a central portion thereof. The piston rod 108 is disposed through the rod aperture 210 and a second end 110 of the piston rod is attached to a handle 112 that is disposed outside 212 of the tube 100.

The handle 112 may be symmetrically disposed with regard to the piston rod 108 or may be asymmetrically disposed with regard to the piston rod, as best seen in FIG. 3. The handle 112 includes recessed finger grooves 146 on a side thereof attached to the piston rod 108. The asymmetric attachment of the handle 112 and the finger grooves 146 may promote a better grip of the handle for ease of use of the manual vacuum pump 50. The handle 112 may be attached to the piston rod 108 by any means known in the art, for example, a mechanical press fit, or an adhesive. The piston rod 108 may have a circular cross section or may have a flattened cross-sectional profile as shown in FIG. 2, or any other cross-sectional profile that may be advantageous for ease of use or manufacture. In this embodiment, the flattened cross section of the piston rod 108 allows the rod to fit between the fingers of a user gripping the handle 112 and may, therefore, promote a better grip and control of the handle for ease of use of the manual vacuum pump 50.

It is also contemplated that a flared member (not shown) may be spaced along the piston rod 108 below the handle 112 to allow a user's fingers to be comfortably disposed between the handle 112 and the flared member. The flared member may enhance the utility of the manual vacuum pump 50 by allowing a user to establish an alternate grip on the handle 112. The flared member may be integral with the handle 112 or separately attached to the piston rod 108.

The end cap 208, which may include knurling 264 to promote ease of installation, may be attached to the second opening 204 of the tube 100 by any means known in the art, for example, by an interference press fit, a tapered press fit, an adhesive, threads, or by a bayonet socket 258, as shown in FIGS. 1-4. The end cap 208 is positioned over the second opening 204 such that longitudinal portions of each bayonet socket 258 line up with each bayonet protrusion 260 that extends from an outer surface 262 of the tube 100. The end cap 208 is forced toward the tube 100 and then rotated until each bayonet protrusion 260 is seated in a corresponding bayonet socket 258 and the end cap is secured to the tube. Thus secured, the end cap 208 provides lateral support for the piston rod 108 that is disposed therethrough, while also providing a path for gas to escape from the tube 100.

As best seen in FIG. 5, the piston 102 includes a top surface 114 on a side connected to the piston rod 108. The piston 102 also includes a bottom surface 116 opposite to the top surface 114. The top surface 114 is essentially planar and the bottom surface 116 includes a recess 118. In this embodiment, the piston 102 is generally cylindrical to accommodate the circular tube 100, and the piston 102 includes a peripheral check valve that comprises a sealing ring, for example, an O-ring 124, seated in a peripheral groove 120 that is recessed into an outer peripheral surface 122 of the piston. The sealing ring may have a cross section that is circular or that is non-circular as known to one of skill in the art. The O-ring 124 is sized to transversely slide across the peripheral groove 120 and make contact with an upper sidewall 121 and a lower sidewall 123 of the peripheral groove. When disposed in contact with the lower sidewall 123, as shown in FIG. 5, the O-ring may make gastight sealing contact with the lower sidewall 123 and an inner surface 126 of the tube 100. A region of relief, for example, a notch 130*a*, is disposed in the outer peripheral surface 122 of the piston 102 from the top surface 114 to the lower sidewall 123 of the peripheral groove 120. The notch 130*a* has a base surface 132 that has a smaller radius with respect to a center of the piston 102 than the base surface 128 of the peripheral groove 120. When disposed in contact with the upper sidewall 121 as shown in FIG. 6, the O-ring 124 is disposed over the notch 130*a*. The depth of the base surface 132 allows clearance between an inner diameter of the O-ring and the base surface 132, and this clearance provides a path, as indicated by the curved arrow 133, through which gas may flow around the piston 102 from the bottom surface 116 to the top surface 114. The piston 102 may have a second notch 130*b*, or any further relief or a number of notches as may be appropriate to accommodate desired levels of gas flow, to preselect the force required to push the piston 102 downward, or for other reasons. In other embodiments (not shown), the piston 102 may have a shape other than cylindrical to accommodate other cross-sectional shapes for the tube 100, as described herein, and may include other types of check valves. For example, the piston 102 may include an aperture therethrough and a mushroom valve disposed in the aperture. As a further example, a flap of resilient material overhanging the bottom surface 116 of the piston 102 at the outer peripheral surface 122 thereof may function as a check valve by forming a seal with the inner surface 126 of the tube 100.

An interface member 134 is mounted to the first end 202 of the tube 100. The interface member 134 includes a generally tapered first end 136 and a generally frustoconical flexible suction cup 138 opposite to the first end. An evacuation aperture 140 extends through the interface member 134 from the generally tapered first end 136 to the flexible suction cup 138. A peripheral groove 142 is recessed into an outer peripheral surface 144 of the interface member 134. The generally tapered first end 136 and the peripheral groove 142 allow the interface member 134 to be press fit into the first opening 200 of the tube 100, wherein end wall 214 of the tube 100 fits into the peripheral groove 142 to hold the interface member within the first opening.

A support assembly 250 is attached to the first end 202 of the tube 100. In the embodiment shown in FIG. 5, the support assembly 250 is press fit over the first end 202 of the tube 100 such that support wall 252 makes contact with the end wall 214. Illustratively, the support assembly 250 includes support members 254 that include distal surfaces that extend longitudinally away a first distance from the first end 202 of the tube 100. The flexible suction cup 138 extends away from the first end 202 of the tube by a second distance, wherein the difference between the second and first distances is sufficient to allow the flexible suction cup to flexibly form a seal against a surface of a container. For example, the first distance may be equal to, less than, or greater than the second distance to accommodate surface geometries of the container and/or the valve. Inner surfaces 256 of the distal surfaces of the support members 254 define an annulus that has a radius greater than a largest radius of the flexible suction cup 138. Therefore, the support members 254 are long enough to allow the flexible suction cup 138 to form a seal against a surface while restricting the flexible suction cup from completely collapsing onto the surface. The support members 254 also allow for the manual vacuum pump 50 to rest on the surface, such as a valve disposed on a pouch, without applying pressure to the entire circumference surrounding the flexible suction cup 138. This facilitates movement of gas from a portion of the pouch outside of the support members 254 to the evacuation aperture 140. Further, by limiting the collapse of the flexible suction cup 138 onto the surface, a valve disposed underneath the non-collapsed portion may open more freely than if disposed under a collapsed portion of the flexible suction cup, facilitating evacuation of the pouch through the valve. The flexible suction cup 138 may have a non-circular footprint, or outer perimeter, and may, for example, have a footprint that is elliptical, oval, square, or another shape tailored to fit a particular container or valve thereon. Correspondingly, the support members 254 may also define a discontinuous or intermittent non-circular shaped footprint surrounding the flexible suction cup 138, while still allowing the suction cup to form a gastight seal with a surface and restricting collapse of the flexible suction cup.

Figure 7:
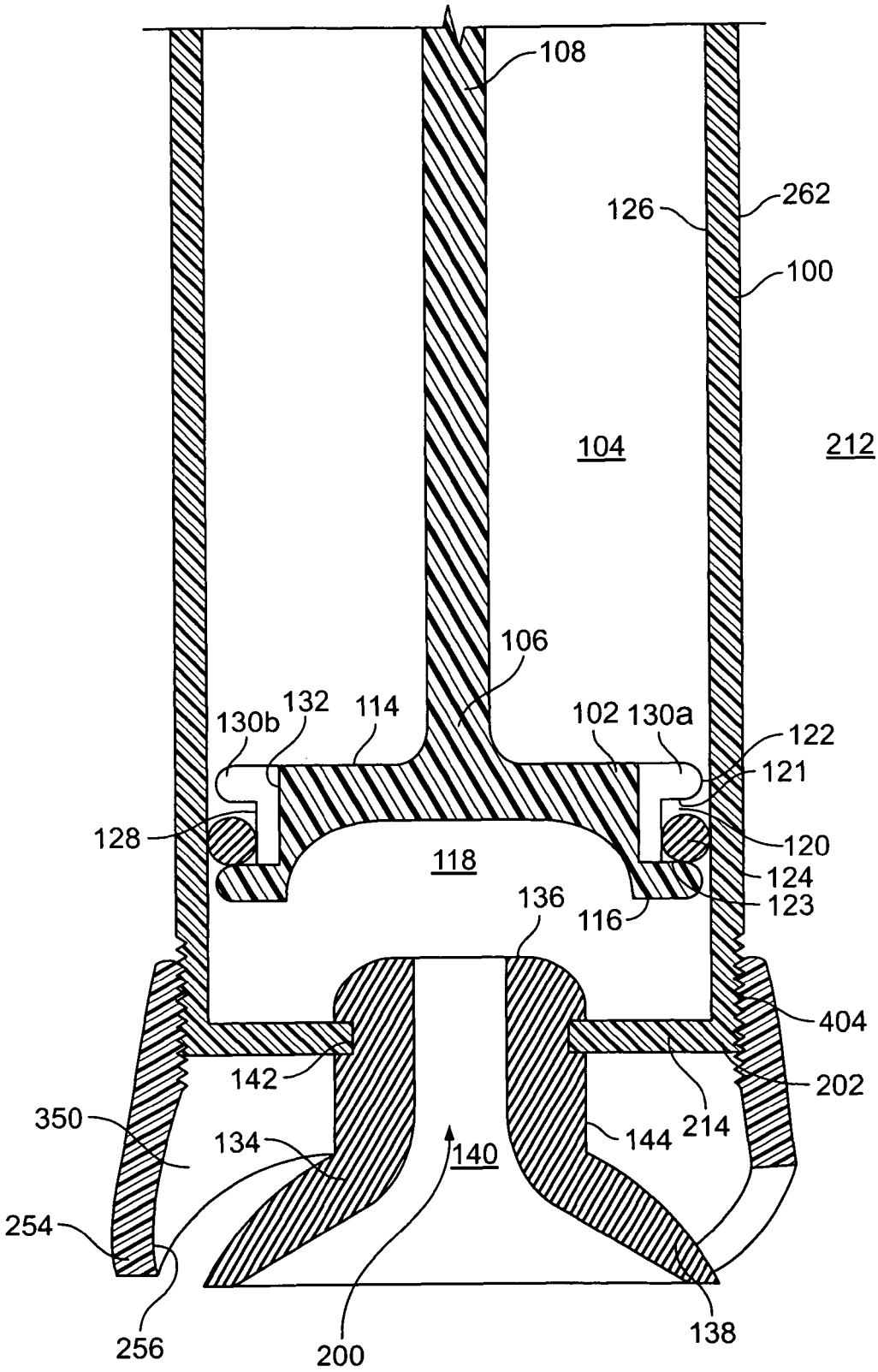
FIG. 7 is an enlarged cross-sectional view of another embodiment of the manual vacuum pump taken generally along the lines 4-4 of FIG. 1.

A surface of a container on which the flexible suction cup 138 is placed may require variable amounts of contact with the flexible suction cup to form a gastight seal therebetween, depending on characteristics of the surface, environmental conditions, the size of a one-way valve disposed on the surface, or other factors. To accommodate these factors while providing a gastight seal between the flexible suction cup 138 and the surface, it may be desirable to be able to adjust the restriction of movement of the flexible suction cup 138 when placed on the surface. FIG. 7 shows an embodiment in which an adjustable support assembly 350 is adjustably attached to the first end 202 of the evacuation chamber 100 in such a manner, for example, via threads 404, which allow the support assembly to be adjusted toward or away from the first end of the evacuation chamber. The support wall 252 shown in FIG. 5 has been omitted in this embodiment to allow a fuller range of travel of the adjustable support assembly 350 through the threaded attachment. By adjusting the position of the adjustable support assembly 350 relative to the first end 202 of the evacuation chamber 100, a user may adjust the first distance that distal surfaces of the support members 254 longitudinally extend from the first end of the evacuation chamber. A larger first distance disposes the distal ends of the support members 254 closer to, or past, the position at which the flexible suction cup 138 is disposed, and, therefore, allows less of the flexible suction cup freedom of motion to contact the surface. A smaller first distance disposes the distal ends of the support members 254 toward the first end 202 allowing a larger portion of the flexible suction cup 138 freedom to contact the surface, creating additional surface contact area to form a gastight seal.

A further embodiment includes an adjustable support assembly 450 having a multi-setting bayonet socket 406 attachment, as illustrated in FIG. 3. A bayonet protrusion 408 extends from the evacuation chamber 100 proximate to the first end 202 thereof. Each bayonet protrusion 408 may be slid along a corresponding bayonet socket 406 and be locked into place at one of several selectable latching positions 410. The latching positions 410 are staggered such that each latching position 410 corresponds to a distinct distance that the support members 254 extend from the first end 202. A user may select the particular latching position 410 as may be desired and as has been described above in regards to FIG. 7.

Figure 8:
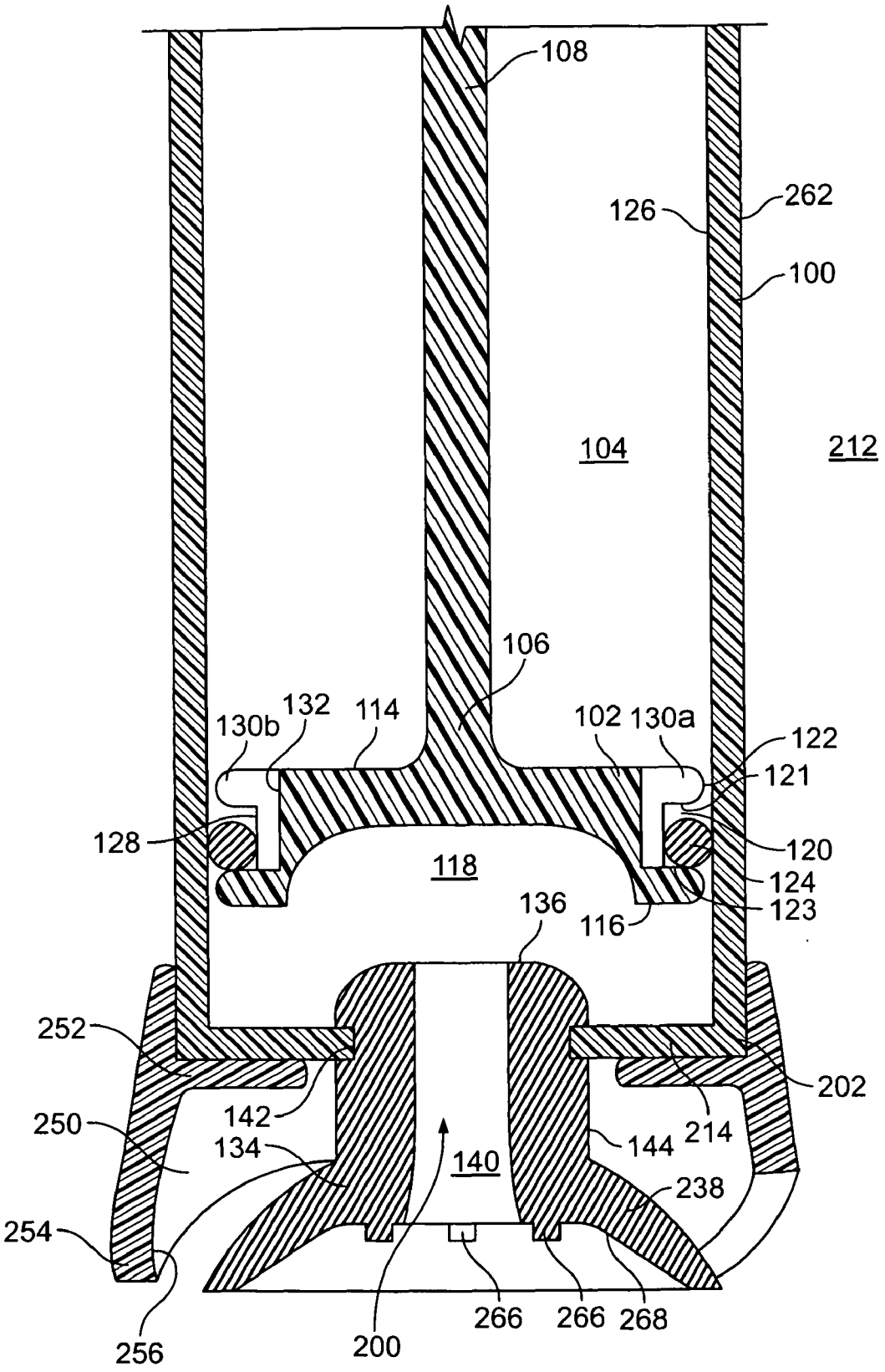
FIG. 8 is an enlarged cross-sectional view of a further embodiment of the manual vacuum pump taken generally along the lines 4-4 of FIG. 1.

In another embodiment, shown in FIG. 8, a flexible suction cup 238 includes a small restraint button 266 disposed within a perimeter of the flexible suction cup and extending from an inner surface 268 thereof. Similar to the support members 254, the restraint button 266 allows the flexible suction cup 238 to engage and to form a seal with a valve on a surface of a container, without blocking off gas flow through the valve. In this embodiment, the flexible suction cup 238 may be advantageous for use with smaller valves or valves that experience a functional enhancement when a portion of the valve is secured from moving.

Figure 9:
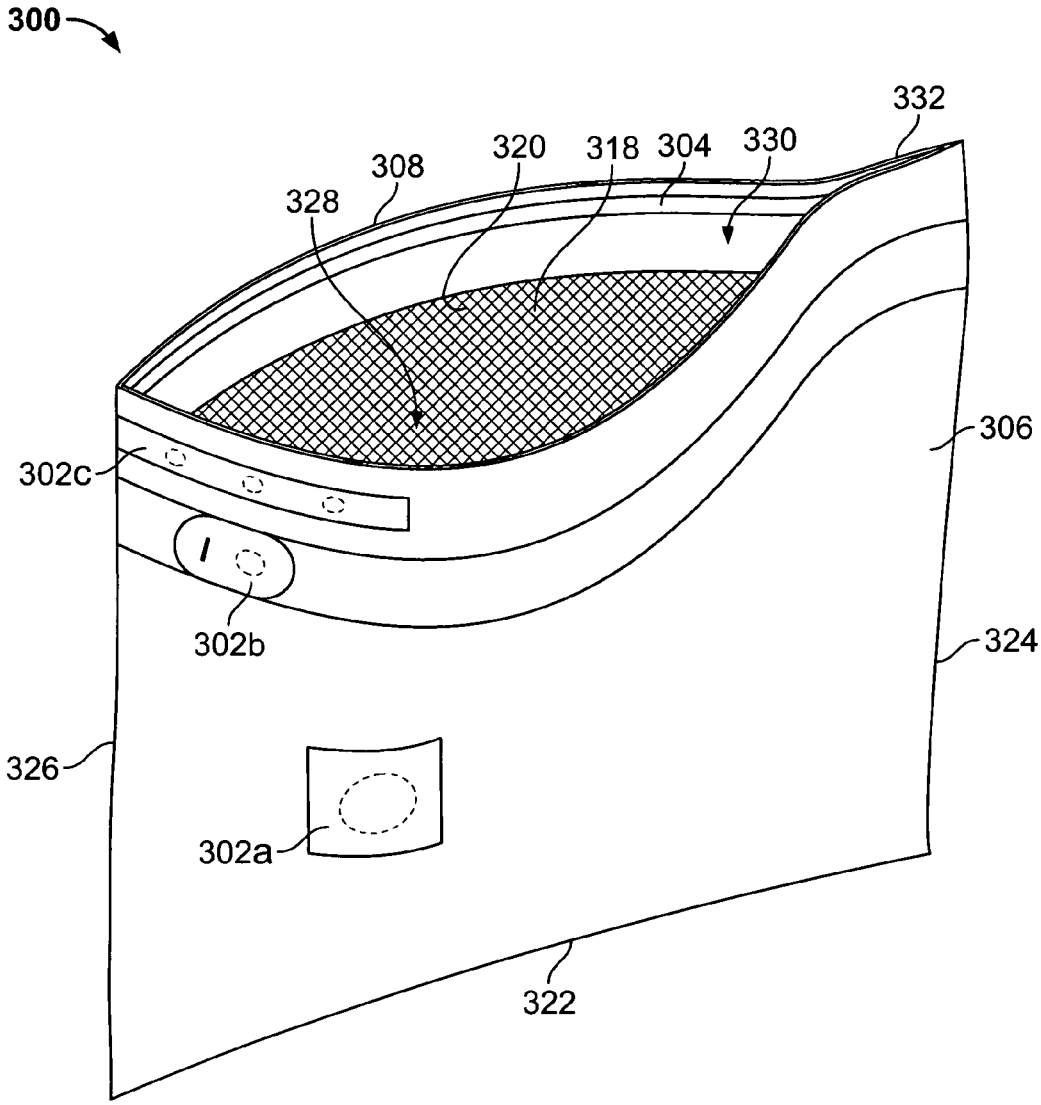
FIG. 9 is an isometric view of a storage pouch including a one-way valve.

Illustratively, an evacuation system employing the manual vacuum pump 50 described herein includes a one-way valve disposed on a container that allows gas to be evacuated from the container. Referring to FIG. 9, a container, such as a storage pouch 300, having a valve 302*a*, 302*b*, or 302*c*, may also include a gastight closure mechanism 304 across a mouth 330 of the storage pouch. Pouch sidewalls 306, 308 are connected, such as by folding, heat seal, and/or adhesive, along the bottom peripheral edge 322 and the lateral peripheral edges 324, 326 to define an interior space 328 therebetween. The mouth 330 is disposed along a top edge 332 where the first and second sidewalls 306, 308 are not connected so as to allow access to the interior space 328. When occluded, the closure mechanism 304 may provide a gastight seal such that a vacuum may be maintained in the interior 328 of the storage pouch 300 for a desired period of time, such as days, months, or years.

The closure mechanism 304 may comprise first and second interlocking closure elements that each may include one or more interlocking closure profiles (not shown). Further, a sealing material, such as a polyolefin material or a caulking composition, such as silicone grease may be disposed on or in the closure elements and closure profiles to fill in any gaps or spaces therein when occluded. The ends of the closure elements and closure profiles may also be welded or sealed by ultrasonic vibrations as is known in the art. Illustrative closure profiles, closure elements, sealing materials, and/or end seals useful in the present invention include those disclosed in Pawloski U.S. Pat. No. 4,927,474, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Anderson U.S. Patent Application Publication No. 2004/0091179, Pawloski U.S. Patent Application Publication No. 2004/0234172, Tilman et al. U.S. Patent Application Publication No. 2006/0048483, Anzini et al. U.S. Patent Application Publication No. 2006/0093242, or Anzini et al. U.S. Patent Application Publication No. 2006/0111226. Other closure profiles and closure elements useful in the present invention include those disclosed in, for example, U.S. patent application Ser. No. 11/725,120, filed Mar. 16, 2007, and U.S. patent application Ser. Nos. 11/818,585, 11/818,586, and 11/818,593, each filed Jun. 15, 2007. It is further appreciated that the closure profiles or closure elements disclosed herein may be operated by hand, or a slider may be used to assist in occluding and de-occluding the closure profiles and closure elements. It is also contemplated that a pouch useful herein may also be closed by other methods known to those skilled in the art other than, or in conjunction with, interlocking profiles, including, for example, heat sealing as disclosed in, for example, Bassett et al. U.S. Patent Application Publication No. 2007/0155607.

The sidewalls 306, 308 of the storage pouch 300, and/or the closure mechanism 304, may be formed from thermoplastic resins by known extrusion methods. For example, the sidewalls 306, 308 may be independently extruded of thermoplastic material as a single continuous or multi-ply web, and the closure mechanism 304 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, the inner surfaces of the respective sidewalls 306, 308 or a portion or area thereof may, for example, be composed of a polyolefin plastomer such as an AFFINITY™ resin manufactured by Dow Plastics. Such portions or areas include, for example, the area of one or both of the sidewalls 306, 308 proximate and parallel to the closure mechanism 304 to provide an additional cohesive seal between the sidewalls when the storage pouch 300 is evacuated of gas. The sidewalls 306, 308 may also be formed of air-impermeable film, such as an ethylene-vinyl alcohol copolymer (EVOH) ply adhesively secured between PP and LDPE plies to provide a multilayer film. Other additives such as colorants, slip agents, and antioxidants, including, for example, talc, oleamide or hydroxyl hydrocinnamate may also be added as desired. The closure mechanism 304 may also be extruded primarily of molten PE with various amounts of slip component, colorant, and talc additives in a separate process. The fully formed closure mechanism 304 may be attached to each sidewall 306, 308 using a strip of molten thermoplastic weld material, or by an adhesive known by those skilled in the art, for example. Other thermoplastic resins and air-impermeable films useful in the present invention include those disclosed in, for example, Tilman et al. U.S. Patent Application Publication No 2006/0048483.

The containers and resealable pouch described herein can be made by various techniques known to those skilled in the art including those described in, for example, Geiger et al. U.S. Pat. No. 4,755,248. Other useful techniques to make a resealable pouch include those described in, for example, Zieke et al. U.S. Pat. No. 4,741,789. Additional techniques to make a resealable pouch include those described in, for example, Porchia et al. U.S. Pat. No. 5,012,561. Additional examples of making a resealable pouch as described herein include, for example, a cast post applied process, a cast integral process, and/or a blown process.

Illustratively, the valve 302*a*-302*c* may be a check valve or a one-way valve, to allow gas to be evacuated from the storage pouch 300 and to maintain a vacuum when the closure mechanism 304, as previously described herein, has been sealed. Illustrative valves useful in the present invention include those disclosed in, for example, Newrones et al. U.S. Patent Application Publication No. 2006/0228057, Buchman U.S. Patent Application Publication No. 2007/0172157, and Tilman et al. U.S. Patent Application Publication No. 2007/0154118. The valve 302*a* may be a flat film valve as disclosed in, for example, Engel et al. U.S. Pat. No. 7,178,555, or a commercially available flat film valve such as, for example, a PLITEK® PV-28 or PV-44, both manufactured by Plitek, LLC, in Des Plaines, Ill. As a further example, the valve 302*b* may be an offset aperture valve as disclosed in U.S. patent application Ser. No. 11/818,591 filed on Jun. 15, 2007.

Further referring to FIG. 9, one or both of the pouch sidewalls 306, 308 may be embossed or otherwise textured with a pattern 318, such as a diamond pattern to create flow channels 320 on one or both surfaces spaced between a bottom peripheral edge 322 of the storage pouch 300 and the closure mechanism 304, or a separate textured and embossed patterned wall (not shown) may be used to provide flow channels within an interior of the storage pouch 300. The flow channels 320 may provide fluid communication between the pouch interior and the valve 302*a*-302*c* when gas is being drawn through the valve. Illustrative flow channels useful in the present invention include those disclosed in, for example, Zimmerman et al. U.S. Patent Application Publication No. 2005/0286808, Buchman U.S. Patent Application Publication No. 2007/0172157, and Tilman et al. U.S. Patent Application Publication Nos. 2006/0048483 and 2007/0154118. Other flow channels useful in the present invention include those disclosed in, for example, U.S. patent application Ser. No. 11/818,584, filed on Jun. 15, 2007.

Figure 10:
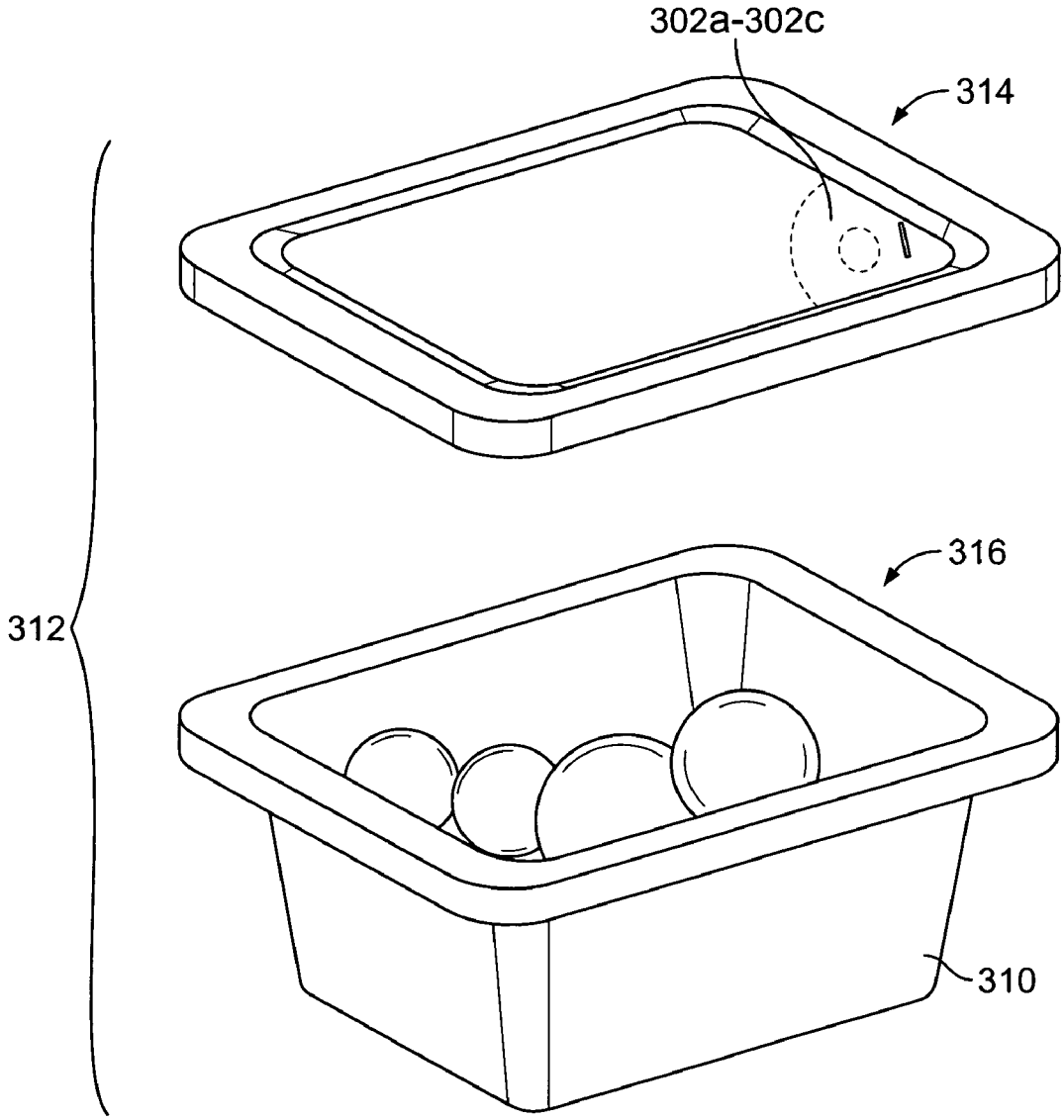
FIG. 10 is an isometric view of a container that has rigid walls and a one-way valve disposed through a lid of the container.
Figure 11:
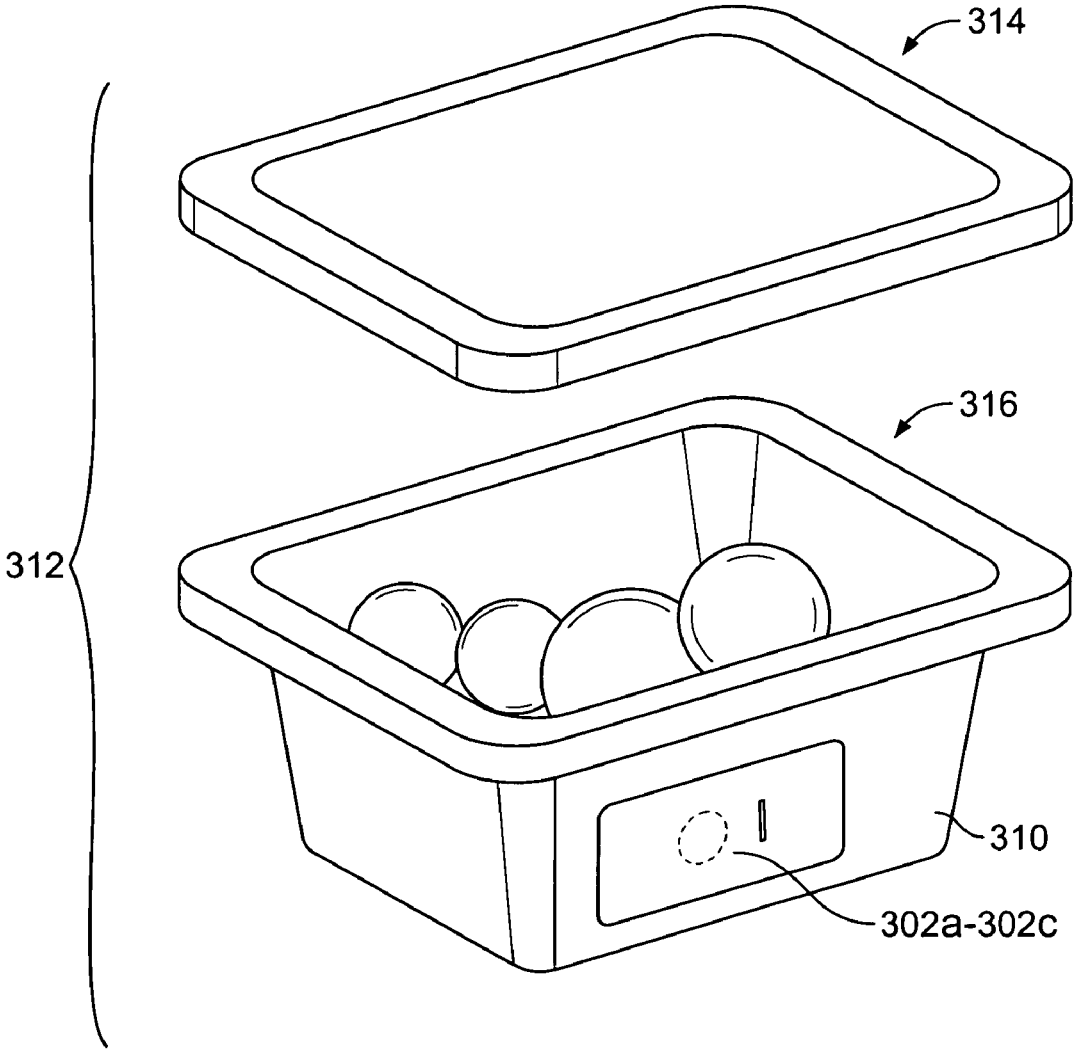
FIG. 11 is an isometric view of a container that has rigid walls and a one-way valve disposed through a rigid wall of the container.

It is further contemplated that a suitable container for use with the manual vacuum pump may include rigid walls 310, as shown in FIGS. 6 and 7, and as disclosed in U.S. patent application Ser. No. 11/818,591, filed Jun. 15, 2007. A container 312 having a container lid 314 that sealingly fits on a hard-walled container body 316 is illustrated. Such a container may also include a flexible and/or an elastic component that collapses as gas is drawn from the container, while the rigid walls 310 maintain their shape. A container useful herein includes those disclosed in, for example, Zettle et al. U.S. Pat. No. 6,032,827 or Stanos et al. U.S. Pat. No. 7,063,231. The valve 302*a*-302*c* may be applied to the lid 314, as shown in FIG. 10, or may be applied to one of the rigid walls 310, as shown in FIG. 11.

The evacuation system described herein is operated, for example, by placing the interface member 134 of the manual vacuum pump 50 over the one-way valve 302*a*-302*c* located on a container. The interface member 134 is positioned over the one-way valve 302*a*-302*c* such that the evacuation aperture 140 is disposed above the one-way valve. The flexible suction cup 138 may now form a seal with a surface surrounding the one-way valve 302*a*-302*c*. As the piston rod 108 is reciprocated upwardly from the tube 100, the O-ring 124 maintains a seal with the inner surface 126 of the tube and the lower sidewall 123 of the peripheral groove 120. A vacuum is created by an expanding volume between the piston 102 and the one-way valve 302*a*-302*c*. The flexible suction cup 138 may partially collapse around a periphery thereof under the force of this vacuum to form a gastight seal with the one-way valve 302*a*-302*c*. However, the support members 254 restrict further collapse of the flexible suction cup 138 that might block gas flow through the valve 302*a*-302*c*. In another embodiment, the restraint button 266 also makes contact with the one-way valve 302*a*-302*c* to further allow the flexible suction cup 238 to engage with and to form a seal with the valve, without blocking gas flow through the valve.

As the piston rod 108 is reciprocated downwardly into the tube 100, the O-ring 124 slides transversely across the peripheral groove 120 to a position wherein the O-ring is disposed over the notch 130*a*. The seal between the O-ring 124 and the lower sidewall 123 of the peripheral groove 120 is broken, allowing passage of gas past the O-ring and through the notch 130*a*. Gas is exhausted from the tube 100 through clearances between the tube and the end cap 208 and between the end cap and the piston rod 108. The evacuation cycle is repeated by reciprocating the piston rod 108 within the tube 100.

INDUSTRIAL APPLICABILITY

The present disclosure provides an evacuation system that comprises a vacuum device that may form a gastight seal with a one-way valve on a container. The evacuation system enables the evacuation of a storage container, such as a vacuum storage pouch, to allow food or other perishables to be stored in the container for an extended period of time.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive rights to all modifications within the scope of the claims are reserved. All patents, patent publications and applications, and other references cited herein are incorporated by reference herein in their entirety.

We claim:

1. A pump for evacuating gases, including air, from a container, the pump comprising:

an evacuation chamber having a closed end and an evacuation end;

a piston slidably disposed within the evacuation chamber and attached to a first end of a piston rod, the piston rod extending through an opening in the closed end of the evacuation chamber and a handle attached to a second end of the piston rod;

a check valve disposed on the piston to allow gas to flow past the piston when the piston is reciprocated toward the evacuation end of the evacuation chamber;

a flexible convex suction cup adapted to form a gastight seal by direct contact with a surface of the container, the flexible convex suction cup extending from the evacuation end of the evacuation chamber, and the flexible convex suction cup having an aperture disposed therethrough for fluid communication with the evacuation chamber; and a plurality of support members extending from the evacuation end of the evacuation chamber to restrict movement of the flexible convex suction cup between the surface and the evacuation end of the evacuation chamber to prevent a portion of the flexible convex suction cup from collapsing onto the surface while still maintaining a gastight seal with the surface, each support member having a distal surface disposed radially outside of an outer circumferential perimeter of a distal end of the flexible convex suction cup.

2. The pump of claim 1, wherein the check valve comprises a peripheral check valve.

3. The pump of claim 2, wherein the peripheral check valve comprises a sealing ring slidably disposed in a groove disposed centrally on a periphery of the piston, and a region of relief disposed on an internal peripheral edge of the piston, the region of relief having a base surface that has a smaller radius with respect to a center of the piston than a base surface of the groove.

4. The pump of claim 1, wherein the plurality of support members comprises three support members that extend from the evacuation end of the evacuation chamber.

5. The pump of claim 1, further comprising a restraint button extending from an inner surface of the flexible convex suction cup.

6. The pump of claim 1, wherein the closed end of the evacuation chamber is formed by a cap that attaches by a bayonet socket to the evacuation chamber at the closed end.

7. The pump of claim 1, wherein the plurality of support members is adjustably attached to the evacuation chamber so as to allow the plurality of support members to be adjusted relative to the evacuation chamber and to move the distal surfaces thereof toward or away from the evacuation end.

8. The pump of claim 7, wherein the plurality of support members is adjustably attached to the evacuation chamber by a threaded attachment.

9. The pump of claim 7, wherein the plurality of support members is adjustably attached to the evacuation chamber by a bayonet socket attachment.

10. The pump of claim 1, wherein the outer perimeter of the flexible convex suction cup is substantially circular in shape.

11. A gastight interface for an evacuation device, the gastight interface comprising:

a flexible convex suction cup adapted to form a gastight seal by direct contact with a surface surrounding a valve disposed on a container, the flexible convex suction cup extending from an evacuation end of an evacuation chamber, and the flexible convex suction cup having an aperture disposed therethrough for fluid communication with the evacuation chamber; and a plurality of support members extending from the evacuation end of the evacuation chamber to restrict movement of the flexible convex suction cup between the surface and the evacuation end of the evacuation chamber to allow fluid communication between an interior of the container and the evacuation chamber through the valve when the valve is in an open position, while the piston is being reciprocated from the evacuation end toward the closed end, each support member having a distal surface disposed outside of an outer perimeter of the flexible convex suction cup.

12. The gastight interface of claim 11, further comprising a plurality of restraint buttons extending from an inner surface of the flexible convex suction cup.

13. The gastight interface of claim 11, wherein the plurality of support members is adjustably attached to the evacuation chamber so as to allow the plurality of support members to be adjusted relative to the evacuation chamber and to move the distal surfaces thereof toward or away from the evacuation end.

14. The gastight interface of claim 11, wherein the outer perimeter of the flexible convex suction cup is substantially circular in shape.

15. A pump for evacuating gases, including air, from a container, the pump comprising:

an evacuation chamber having a closed end and an evacuation end;

a piston slidably disposed within the evacuation chamber and attached to a first end of a piston rod, the piston rod extending through an opening in the closed end of the evacuation chamber and a handle attached to a second end of the piston rod;

a check valve disposed on the piston to allow gas to flow past the piston when the piston is reciprocated toward the evacuation end of the evacuation chamber;

a flexible suction cup adapted to form a gastight seal with a surface and extending from the evacuation end of the evacuation chamber, the flexible suction cup having an aperture disposed therethrough for fluid communication with the evacuation chamber; and a plurality of support members extending from the evacuation end of the evacuation chamber to restrict movement of the flexible suction cup between the surface and the evacuation end of the evacuation chamber to prevent a portion of the flexible suction cup from collapsing onto the surface while still maintaining a gastight seal with the surface, each support member having a distal surface disposed radially outside of an outer circumferential perimeter of a distal end of the flexible suction cup, wherein the plurality of support members defines an intermittent footprint surrounding the flexible suction cup.

* * * * *